United States Patent [19]

Zedrosser

[11] Patent Number: 4,848,237

[45] Date of Patent: Jul. 18, 1989

[54] PERIPHERAL PRIMER FIREARM CARTRIDGE

[75] Inventor: Ulrich Zedrosser, Steyr, Austria

[73] Assignee: Steyr-Daimler-Puch AG, Vienna, Austria

[21] Appl. No.: 125,535

[22] Filed: Nov. 25, 1987

[30] Foreign Application Priority Data

Dec. 2, 1986 [AT] Austria ..... 3203/86

[51] Int. Cl.[4] ..... F42B 5/313; F42B 5/32

[52] U.S. Cl. ..... 102/471; 102/430; 102/466

[58] Field of Search ..... 102/430, 441, 464, 465, 102/466, 467, 468, 469, 470, 433, 434, 443, 471

[56] References Cited

U.S. PATENT DOCUMENTS

| | | | |
|---|---|---|---|
| 1,470,591 | 10/1923 | Behar | 102/430 |
| 2,306,551 | 12/1942 | Maroney | 102/443 |
| 2,379,056 | 6/1945 | Alexander | 102/471 |
| 2,922,341 | 1/1960 | Treat | 102/470 |
| 2,931,093 | 4/1960 | Henning et al. | 102/464 |
| 2,996,988 | 8/1961 | Kunz | 102/433 |
| 3,046,890 | 7/1962 | Dardick | 102/434 |
| 3,547,030 | 12/1970 | Kamp | 102/434 |
| 3,609,904 | 10/1971 | Scanlon | 102/466 |
| 3,611,937 | 10/1971 | Hildebrand | 102/446 |
| 3760,729 | 9/1973 | Freeman | 102/466 X |
| 4,537,134 | 8/1985 | Galluzzi | 102/430 |

FOREIGN PATENT DOCUMENTS

| | | |
|---|---|---|
| 1958925 | 5/1971 | Fed. Rep. of Germany . |
| 2209459 | 9/1973 | Fed. Rep. of Germany . |
| 2320399 | 10/1974 | Fed. Rep. of Germany . |
| 2850879 | 6/1980 | Fed. Rep. of Germany . |
| 1571251 | 5/1969 | France . |
| 2090939 | 12/1971 | France . |
| 2140089 | 1/1973 | France . |

*Primary Examiner*—Deborah L. Kyle
*Assistant Examiner*—Michael J. Carone
*Attorney, Agent, or Firm*—Marmorek, Guttman & Rubenstein

[57] ABSTRACT

A cartridge comprises a preferably closed case, which contains a propellant charge and a priming material and which at its head end constitutes a bushinglike socket for receiving a projectile. In order to provide a reliable cartridge which can be manufactured in a simple manner and can be radially or tangentially ignited, the case comprises adjacent to its periphery at least one peripheral annular groove, which is open to the interior of the case and contains the priming material.

11 Claims, 1 Drawing Sheet

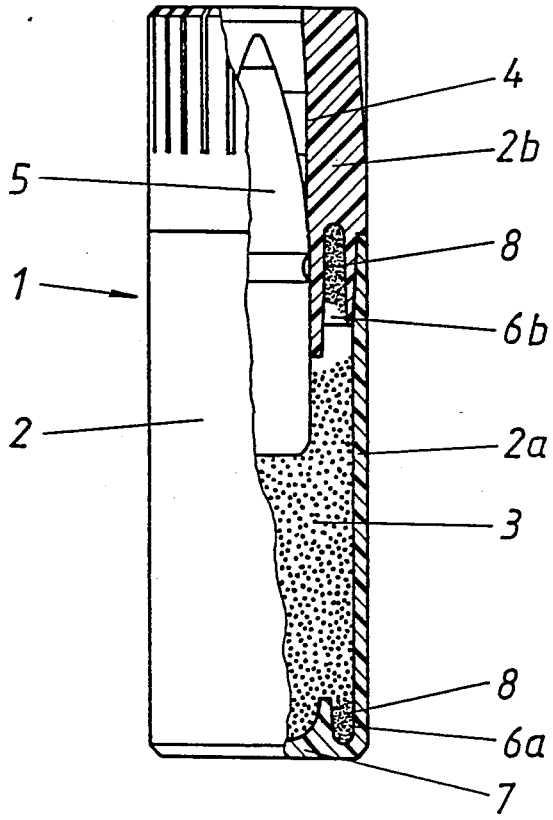
4
2b
5
8
1
6b
2
2a
3
8
6a
7

PERIPHERAL PRIMER FIREARM CARTRIDGE

BACKGROUND OF THE INVENTION

1. Field of the Invention

This invention relates to a cartridge for firearms, comprising a plastic case which contains a propellant charge and a priming material, and which at its head end constitutes a bushing-like socket containing a projectile.

2. Description of the Prior Art

Cartridge cases do not serve only to interconnect the projectile, propellant charge and primer and to protect said parts but, above all, are intended to ensure a firm and centering retention of the projectile and to contribute to the sealing of the chamber of the firearm as the propellant charge is ignited and the round is discharged. To meet said requirements, the cases of most live cartridges have previously consisted of metal although this involves high manufacturing costs and a heavy weight of the cartridge. Attempts to use caseless cartridges have not been successful because without the protecting, guiding and sealing actions of the case the effect of the cartridge is not ensured and the firearm becomes unreliable.

Plastic cartridge cases have been provided in an effort to retain the advantages afforded by a cartridge case but to reduce the manufacturing costs and the cartridge weight. Such plastic cartridge cases have a sufficiently strong bushing-like socket, in which the projectile is sufficiently safely and sealingly retained whereas the propellant charge is contained in the interior of the case adjacent to the socket. The priming material consisting, e.g., of a primer cap is centrally disposed in the case adjacent to its bottom so that an axial firing pin or other axially acting firing means are required. But such firing means are rather expensive and liable to be deranged and add to the overall length of the firearm. Besides, said firing means and the centrally disposed primer caps or the like associated with them permit a point-ignition of the propellant charge so that the propellant charge is not completely burnt and, as a result, propelling force may be reduced and residues of unburnt powder may be left. Besides, plastic cases which owing to their low strength remain in the chamber after the round has been discharged cannot simply be extracted, like metal cases, from the chamber by extractor hooks. For this reason, cartridges having plastic cases cannot reliably be discharged unless special breechblock and loading means are used which are provided with a loading member that constitutes the chamber and is separate from and transversely movable relative to the barrel. For this reason that loading member can be moved from a firing position, in which the chamber is coaxial to the barrel, to a loading and unloading position, in which the chamber is open and, above all, the plastic cases can satisfactorily be ejected from the chamber. But in that case the plastic case must perform important sealing functions in the chamber for the discharge of the round and that object is often only poorly accomplished in cartridges which have bottom primers and are associated with corresponding firing means. Besides, the bottom of the plastic case must have a substantial wall thickness for a reliable accommodation of the primer cap or the like so that the case volume that is available for the propellant charge will be reduced or the length of the case will be increased.

SUMMARY OF THE INVENTION

For this reason it is an object of the invention to eliminate these disadvantages and to provide a cartridge which is of the kind described first hereinbefore and can be economically manufactured, requires no axially acting firing means and will establish optimum conditions for a complete combustion of the propellant charge.

This object is accomplished in accordance with the invention in that the case has adjacent to its periphery at least one peripheral annular groove, which is open to the interior of the case and contains the priming material. Owing to that simple feature the cartridge having a plastic case comprises at least one rim primer, which can be detonated by radially or tangentially acting firing means and which permits all disadvantages of axially acting firing means to be avoided. As the rim primer surrounds the propellant charge like a ring, the ignition may be effected at any desired point of the periphery and the propellant charge will not be ignited from an internally disposed point but from an external annulus so that a reliable and complete combustion of the propellant charge will be ensured. As the annular grooves can be formed without an additional expenditure during the shaping of the plastic sleeve and an increase of the thickness of the case bottom is not required, the cartridge comprising the plastic case is inexpensive and reliable and has a small length.

In a desirable embodiment of the invention the socket-forming head part of the case consists of a component which is separate from the case body, and the head part and/or the case body is formed with an annular groove. Because the case consists of two parts, the entire manufacturing sequence can be performed more economically and the case bodies can readily be combined with different head portions in the manufacture of cartridges of different kinds, such as live cartridges, blank cartridges, illuminating cartridges or the like. Besides, that division into two parts will simplify the formation of the annular grooves. To facilitate the demolding of the plastic case the parting line may be disposed adjacent to the or one annular groove. It is possible to provide only one or each of the parts consisting of the head part and the case body with a rim primer so that the cartridge can be used with firing means of one kind or another. If rim primers are provided in the head part and in the case body, the cartridge can be fired with different firing means and can be discharged from arms of different types.

In accordance with the invention the annular groove in the head part may extend adjacent to the socket and/or the annular groove in the case body may extend adjacent to the bottom of the cartridge case. In that case sufficiently strong abutments will be provided for the rim primers by the projectile at one end and owing to the stiffness of the preferably entirely closed bottom of the case at the other end without a need for special additional measures. This is important because the priming material of the rim primers must be squeezed by the firing means acting thereon when the cartridge is to be discharged.

BRIEF DESCRIPTION OF THE DRAWINGS

The drawing is a diagrammatic side elevation, which shows partly in section a cartridge in accordance with the invention.

DETAILED DESCRIPTION OF THE PREFERRED EMBODIMENT

A cartridge 1 comprises a plastic case 2, which consists of namely, a case body *2a*, which contains a propellant charge 3, and two parts of a head part *2b*, which constitutes a bushing-like socket 4 that retains a projectile 5. The case body *2a* and the head part *2b* of the plastic case 2 are formed with respective annular grooves *6a*, *6b*, which are open to the interior of the case and which are respectively disposed at the rim of the entirely closed bottom 7 of the case 2 and around the socket 4 adjacent to the parting line of the case and which contain a priming material 8.

The cartridge 1 can be manufactured economically and comprises a plastic case 2, which is provided with rim primers, *6a*, *6b*; 8. It will be understood that the cartridge 1 for use with firearms having firing means requiring one or the other of the rim primers may be provided with a rim primer only in the case body *2a*. But in that case the cartridge will always require suitable firing means and cannot be discharged with firing means of one type and the other.

It is apparent from the drawing that each of the annular grooves *6a* and *6b* extends peripherally and axially and opens axially into the interior of the case so that the grooves can accommodate a large volume of priming material within a small radial extent.

I claim:

1. A cartridge for firearms, comprising a projectile, a propellant charged for acting on said projectile, a priming material for igniting said propellant charge, and a substantially hollow cartridge case comprising a head part which constitutes a bushing-like socket containing said projectile, said case also containing said propellant charge and said priming material, said case being made from a plastic material, said case being formed adjacent to its periphery with at least one axially extending circumferential partition defining a peripheral annular groove, said annular groove being open to the interior of said case in an axial direction and containing said priming material, said head part being formed with said groove.

2. The cartridge set forth in claim 1, wherein said case comprises two separate parts respectively consisting of said head part and of a case body.

3. The cartridge improvement set forth in claim 2, wherein said case body is formed with said groove.

4. The improvement set forth in claim 3, wherein said case body has a bottom opposite to said head part and said groove in said case body is disposed adjacent to said bottom.

5. The cartridge set forth in claim 3, wherein said case body comprises a bottom opposite to said head part, said head part and said case body are formed each with one of said grooves, said groove in said head part is disposed adjacent to said socket, and said groove in said case body is disposed adjacent to said bottom.

6. The improvement set forth in claim 2, wherein said head part and said case body are formed each with one of said grooves.

7. The cartridge set forth in claim 1, wherein said groove in said head part is disposed adjacent to said socket.

8. The cartridge set forth in claim 1, wherein said annular groove extends peripherally and axially and opens axially into the interior of said case.

9. A cartridge for firearms comprising a projectile, a propellant charge for acting on said projectile, a priming material for igniting said propellant charge, and a cartridge case comprising a head part and a case body, said head part constituting a bushing-like socket containing said projectile, said case also containing said propellant charge and said priming material, said case being made from a plastic material, each of said head part and said case body including an annular groove which is formed adjacent to the periphery of said case, is open to the interior of said case, and contains said priming material.

10. The cartridge set forth in claim 9 wherein said case body comprises a bottom opposite to said head part, said groove in said head part being disposed adjacent to said socket, and said groove in said case body being disposed adjacent to said bottom.

11. The cartridge set forth in claim 10 wherein each of said annular grooves extends peripherally and axially, and opens axially into the interior of said case.

* * * * *